United States Patent [19]

Walborn

[11] 4,282,787

[45] Aug. 11, 1981

[54] ELECTRONIC MUSICAL INSTRUMENT SIMULTANEOUSLY OPERABLE IN MONOPHONIC AND POLYPHONIC MODES

[75] Inventor: Richard M. Walborn, Tonawanda, N.Y.

[73] Assignee: Norlin Industries, Inc., Deerfield, Ill.

[21] Appl. No.: 122,340

[22] Filed: Feb. 19, 1980

[51] Int. Cl.[3] ..... G10H 1/00

[52] U.S. Cl. ..... 84/1.01; 84/1.17; 84/DIG. 20

[58] Field of Search ..... 84/1.01, 1.17, DIG. 20, 84/DIG. 22

[56] References Cited

U.S. PATENT DOCUMENTS

| | | | |
|---|---|---|---|
| 3,825,668 | 7/1974 | Okamoto | 84/1.22 |
| 3,922,943 | 12/1975 | Niinomi | 84/1.22 |

OTHER PUBLICATIONS

Service Manual for Model CDX-0652 Electronic Organ.

*Primary Examiner*—B. Dobeck
*Assistant Examiner*—Forester W. Isen
*Attorney, Agent, or Firm*—Jack Kail; Ronald J. Kransdorf

[57] ABSTRACT

An electronic musical instrument having combined monophonic and polyphonic sound producing capabilities includes a keyboard simultaneously operating a monophonic tone signal generating circuit and a polyphonic tone signal generating circuit. The tone signals produced by the tone generating circuits are combined and coupled through a single signal processing stage and therefrom to an output speaker. A gate signal for enabling the monophonic tone signal generating circuit and for operating the signal processing stage is derived at the output of a detector circuit which is responsive to the presence of an audio output from the polyphonic tone signal generating circuit.

11 Claims, 1 Drawing Figure

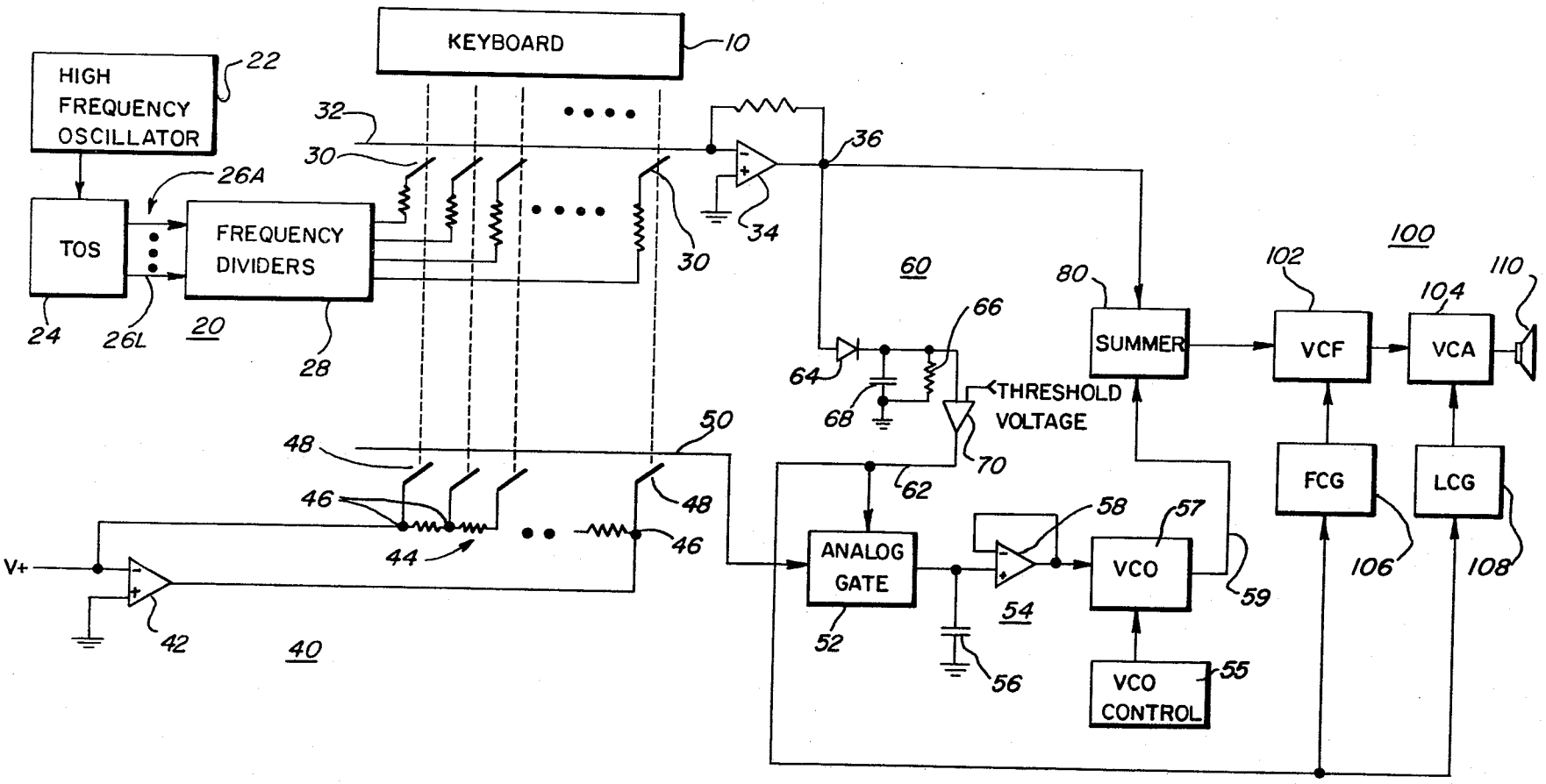
KEYBOARD
HIGH FREQUENCY OSCILLATOR
TOS
FREQUENCY DIVIDERS
SUMMER
THRESHOLD VOLTAGE
VCF
VCA
FCG
LCG
VCO
VCO CONTROL
ANALOG GATE
V+
10
20
22
24
26H
26L
28
30
32
34
36
40
42
44
46
48
50
52
54
55
56
57
58
59
60
62
64
66
68
70
80
100
102
104
106
108
110

ELECTRONIC MUSICAL INSTRUMENT SIMULTANEOUSLY OPERABLE IN MONOPHONIC AND POLYPHONIC MODES

BACKGROUND OF THE INVENTION

The present invention relates generally to electronic musical instruments of the keyboard type and, more particularly, to a keyboard electronic musical instrument which is capable of simultaneously operating a monophonic and a polyphonic mode.

Keyboard type electronic musical instruments, e.g. syntehsizers, are frequently categorized according to the number of notes which may simultaneously be produced through operation of the keys of the instrument. For example, most early synthesizers were monophonic in nature in that only a single output note could be sounded regardless of the number of keys depressed. In multiphonic musical instruments, the number of keys which may simultaneously be depressed for designating notes to be sounded is increased to a limited extent, usually up to about ten. Most recently, polyphonic synthesizers have become available wherein any or all of the notes represented by the keys of the keyboard may be simultaneously designated for sounding.

It has heretofore been realized that certain desirable musical effects may be realized by providing a single electronic musical instrument capable of simultaneously operating in, for example, both monophonic and polyphonic modes. The advantages achieved as a consequence of this combined mode of operation are largely attributable to the different techniques normally used to implement monophonic and polyphonic capabilities. More specifically, monophonic type electronic musical instruments conventionally employ a resistive voltage divider and a keyboard operated switch matrix for developing, on a priority basis, a control voltage on an output bus proportional to the pitch of a single depressed keyboard key. At the same time, a gate or trigger signal is developed indicating that a key has been depressed, the gate signal operating an analog gate for coupling the control voltage through a sample and hold circuit to the control input of a voltage controlled oscillator. The output of the voltage controlled oscillator therefore constitutes an audio signal having a frequency corresponding to the pitch of the key whose depression produced the control voltage. This audio signal is typically coupled through a voltage controlled filter and a voltage controlled amplifier, both of which are operated in response to the gate signal, and thence to a speaker for conversion to an audible signal.

Various different techniques are known for developing the gate signal used for controlling the operation of monophonic synthesizers. In one technique, a second switch matrix, ganged with the control voltage producing switch matrix, is provided to develop a gate signal on a second bus any time a key is depressed. A second technique involves the use of a high frequency oscillator to impress an AC signal on the resistive voltage divider, which signal is subsequently extracted from the control voltage and detected to form the gate signal.

Polyphonic synthesizers, on the other hand, conventionally employ means such as a top octave synthesizer together with a series of frequency divider chains for producing a plurality of tone signals to simultaneously make available all notes represented by the keys of the keyboard. The tone signals are then selectively keyed by a switch matrix to an output bus which, in turn, is coupled to an output system normally also comprising voltage controlled filter and amplifier stages. The gate signal for operating these latter stages is usually derived from a second bus which is responsive to a second switch ganged with the keying switch matrix.

It can thus be seen that the circuits used to implement monophonic and polyphonic capabilities in electronic musical instruments differ rather dramatically, the former using a voltage controlled oscillator to generate one tone signal at a time and the latter using a top octave synthesizer and a series of divider chains for simultaneously generating a plurality of tone signals. In addition, the effects achievable by suitably controlling the two tone generation systems are quite different wherein an extremely flexible system is realized by combining both polyphonic and monophonic capabilities in a single instrument. In the past, this combination has been effected by simply combining a complete polyphonic system with a complete monophonic system and ganging the respective key switches of the two systems to the associated keys of a single keyboard. The resulting combined system therefor includes, in addition to two tone generating systems, two separate signal processing sections, one for processing the polyphonic tone signals and one for processing the monophonic tone signals. The gate signal in such prior art systems is formed by one of the techniques discussed above, i.e. either using an additional bus and switch matrix or employing a high frequency oscillator to impress an AC signal on the resistive voltage divider of the monophonic stage. As a consequence of the foregoing, the cost and complexity of prior art combined monophonic-polyphonic systems has been relatively high thereby detracting from their desirability.

It is accordingly a primary object of the invention to provide a low-cost keyboard electronic musical instrument capable of simultaneously operating in both monophonic and polyphonic modes. It is a further object of the invention to provide a novel and improved technique for deriving the necessary gating signal in such an instrument, which technique avoids the additional costs and complexities characterizing prior art approaches.

SUMMARY OF THE INVENTION

The foregoing and other useful objects are achieved according to the invention by an electronic musical instrument which comprises a single keyboard, a polyphonic tone signal generating stage including a key switch matrix responsive to operation of the keyboard keys and a monophonic tone signal generating stage also including a switch matrix ganged for operation together with the switch matrix of the polyphonic stage. The audio tone signals developed by the polyphonic stage are coupled to a detector circuit which, in response thereto, forms a DC gate signal. The gate signal is used for enabling operation of the monophonic stage for producing an output tone signal which is combined with the output tone signals produced by the polyphonic stage in a summing circuit. The output of the summing circuit, which includes both monophonic and polyphonic tone signal components, is coupled through signal processing stages such as voltage controlled filters and amplifiers which are operated in response to the DC gate signal and therefrom to an output speaker system for conversion to an audible signal.

BRIEF DESCRIPTION OF THE DRAWING

The sole FIGURE illustrates, partly in block diagram form and partly in schematic form, a preferred embodiment of an electronic musical instrument constructed according to the present invention.

DESCRIPTION OF THE PREFERRED EMBODIMENT

Referring to the FIGURE, a preferred form of an electronic musical instrument constructed in accordance with the present invention basically comprises a keyboard 10, a polyphonic tone signal generating stage 20, a monophonic tone signal generating stage 40, a detector circuit 60 for developing a gate signal in response to the depression of a keyboard key, a summing circuit 80 for combining the tone signals developed by the polyphonic stage 20 and the monophonic stage 40 and an output system 100 which includes a series of tone signal processing sections and a loudspeaker 110 for converting the processed tone signals into a corresponding acoustical wave.

The polyphonic tone signal generating stage 20 comprises a high frequency oscillator 22 supplying a stream of high frequency clock pulses to the input of a top octave synthesizer 24. The top octave synthesizer 24, which consists of a conventional device such as generator MM5832 manufactured by National Semiconductor Corporation, divides the clock pulses supplied by the oscillator 22 an appropriate number of times for producing an octave of chromatic frequencies corresponding to the semitones or notes within an octave which is one octave higher in pitch than the highest octave on the keyboard 10. The twelve tone pulse waveforms representing these chromatic frequencies are coupled by twelve output lines 26A–26L to a series of divide by two frequency divider chains 28. The outputs of the frequency dividers within the divider chains 28 therefore simultaneously make available a plurality of tone signals each of which represents a note corresponding to one of the keys of the keyboard 10.

Each one of the plurality of tone signals developed by the frequency divider chains 28 is resistively coupled by a respective key operated switch 30 to a bus bar 32. Thus, each time a particular key is depressed on the keyboard 10, the associated switch 30 is operated for coupling a tone signal having a frequency corresponding to the pitch of the depressed key from one output of the frequency divider chains 28 to the bus bar 32. The depression of two keys results in the operation of the associated two switches 30 for coupling two tone signals to the bus bar 32 having frequencies corresponding to the pitches of the notes of the depressed keys, and so on. In other words, since the frequency divider chains 28 simultaneously make available tone signals representing all of the notes of the keyboard 10, and since any one of the tone signals may be independently coupled to the bus bar 32 by operating the associated key switch 30, the system 20 represents a true polyphonic tone generating system. The tone signals coupled to the bus bar 32 from the frequency divider chains 28 are summed by an operational amplifier 34 and developed as an output polyphonic audio signal at a node 36.

The monophonic tone signal generating stage 40 comprises an operational amplifier 42 including a resistive voltage divider 44 connected between its inverting input and its output. The inverting input of the operational amplifier 42 is also supplied with a source of positive potential while the non-inverting input of the amplifier is connected to a source of ground potential. As a consequence, a current is established in the voltage divider 44 for causing a linear sequence of control voltages to be developed at the output taps 46 of the voltage divider 44. Each of the output taps 46 of the voltage divider 44 is connected by a respective switch 48 to a second bus bar 50. Each of the switches 48 is ganged for operation together with one of the switches 30 in response to the depression of one of the keys of the keyboard 10. Thus, in response to the depression of a selected key on the keyboard 10, a tone signal having a frequency corresponding to the pitch of the selected note is coupled to the bus bar 32 of the polyphonic stage 20 while a control voltage representing the same note is coupled to the bus bar 50 of the monophonic stage 40. As is well known in the art, regardless of the number of keys depressed on the keyboard 10, only a single control voltage at a time may be coupled to the bus bar 50 by the key operated switches 48. As a consequence, the tone generating stage 40 is operable only in a monophonic mode.

The control voltage developed on the bus bar 50 of the monophonic stage 40, which represents the pitch of a note corresponding to a depressed key on the keyboard 10, is coupled through an analog gate 52 and a sample and hold circuit 54, including a capacitor 56 and an operational amplifier 58, to the input of a voltage controlled oscillator 57. The voltage controlled oscillator 57 is operable in response to the control voltage for producing an output tone signal on a conductor 59 whose frequency corresponds to the pitch of the note of the keyboard key whose operation resulted in the establishment of the control voltage on the bus bar 50. A conventional VCO control circuit 55 may also be provided for controlling the operation of the oscillator in a well known manner.

It is of course desired that the analog gate 52 be operated for coupling the control voltage on the bus bar 50 to the voltage controlled oscillator 57 only so long as a key is depressed on the keyboard 10. This is accomplished according to the invention by gating the analog gate 52 in response to the presence of a polyphonic audio signal at the output node 36 of the polyphonic stage 20. In this regard, it will be appreciated that an audio signal is developed at the node 36 only so long as one or more of the keys of the keyboard 10 are depressed. More particularly, the output node 36 of the polyphonic stage 20 is coupled to the detector circuit 60 which forms a DC gate signal on an output conductor 62 in response to the presence of an audio signal at the node 36. The detector circuit 60 comprises a rectifying diode 64 and a filter circuit formed by the parallel combination of a resistor 66 and a capacitor 68. A DC signal is developed at the junction formed between the diode 64, the resistor 66 and the capacitor 68 whenever an audio signal is developed at the node 36. While this DC signal may be used as the gate signal, it is considered desirable to include an output comparator 70 for increasing the noise immunity characteristics of the detector circuit 60. The comparator 70 is thus operative for developing the gate signal on the output conductor 62 in response to the DC voltage developed at the junction common to the diode 64, the resistor 66 and the capacitor 68 exceeding a predetermined threshold level.

The polyphonic tone signals developed at the node 36 together with the monophonic tone signal developed at the output 59 of the voltage controlled oscillator 57 are combined in a summing circuit 80 and coupled therefrom to the signal processing stage 100. The signal processing stage 100 typically includes a voltage controlled filter 102 and a voltage controlled amplifier 104. As is well known in the art, the voltage controlled filter 102 is operated in response to a contour generator 106 for controlling the harmonic spectrum of the tone signals supplied thereto while the voltage controlled amplifier 104 is responsive to a contour generator 108 for controlling the amplitude of the tone signals developed at the output of the filter 102.

Normally, it is desired to operate the voltage controlled filter 102 and the voltage controlled amplifier 104 only while one or more keys of the keyboard 10 is depressed. Therefore, the gate signal developed at the output conductor 62 of the detector circuit 60 is coupled for gating the contour generators 106 and 108. The contour generators 106 and 108 are therefore effective for operating the voltage controlled filter 102 and the voltage controlled amplifier 104 only in response to the existence of the gate signal which, in turn, is developed only when one or more of the keys of the keyboard 10 have been depressed. The processed tone signals developed at the output of the voltage controlled amplifier 104 are then, of course, coupled to the speaker 110 for conversion to corresponding audible tones.

What has thus been shown is an improved electronic musical instrument including a single keyboard simultaneously operating a polyphonic tone signal generating stage and a monophonic tone signal generating stage. The outputs of the two tone signal generating stages are combined and coupled through a single signal processing stage to an output speaker. In addition, a detector circuit responsive to the polyphonic tone signal generating stage is provided for developing a gate signal for enabling the monophonic tone signal generating stage and for controlling the output signal processing circuits.

While a particular embodiment of the particular invention has been shown and described, it will be obvious to those skilled in the art that various changes and modifications may be made without departing from the invention and its broader aspects. The aim of the appended claims, therefore, is to cover all such changes and modifications as fall within the true spirit and scope of the invention.

What is claimed is:

1. An electronic musical instrument having combined monophonic and polyphonic sound producing capabilities comprising:

a plurality of player operable keys each representing a different pitch of a musical scale;

polyphonic means for producing a first audio signal having frequency components representing the pitches of all of said keys which are depressed;

means for producing a gate signal in response to the detection of the presence of said first audio signal;

monophonic means enabled in response to said gate signal for producing a second audio signal having a frequency representing the pitch of only one of said keys which are depressed;

means for producing a third audio signal representing the sum of said first and second audio signals; and output means responsive to said gate signal for controllably processing said third audio signal.

2. An electronic musical instrument according to claim 1 wherein said means for producing a gate signal comprises a detector circuit for developing a DC voltage in response to said first audio signal, said DC voltage comprising said gate signal.

3. An electronic musical instrument according to claim 2 wherein said monophonic means comprises means for producing a control voltage representative of the pitch of a depressed one of said keys, a voltage controlled oscillator and an analog gate for coupling said control voltage to said voltage controlled oscillator in response to said gate signal.

4. An electronic musical instrument according to claim 3 wherein said polyphonic means includes a first bus bar and a plurality of first switches each operable in response to depression of a respective one of said keys for coupling an audio signal to said first bus bar having a frequency representing the pitch of the key associated therewith.

5. An electronic musical instrument according to claim 4 wherein said monophonic means includes a second bus bar and a plurality of second switches each operable together with a respective one of said first switches for coupling said control voltage to said second bus bar.

6. An electronic musical instrument according to claim 5 wherein said output means includes a voltage controlled filter and a voltage controlled amplifier and means for operating said voltage controlled amplifier and filter in response to said gate signal.

7. In an electronic musical instrument of the type having a keyboard and an output system, the improvement comprising:

means for developing a polyphonic audio signal in accordance with the operation of said keyboard;

means for producing a gate signal in response to said polyphonic signal;

a voltage controlled oscillator;

means developing a voltage control signal representing the pitch of a single depressed key of said keyboard;

gate means responsive to said gate signal for coupling said voltage control signal to said voltage controlled oscillator for developing a monophonic audio signal representing said single operated key; and means for coupling said polyphonic and monophonic audio signals to said output system.

8. The improvement according to claim 7 wherein said output system includes at least one voltage controlled circuit operable in response to said gate signal.

9. The improvement according to claim 8 wherein said means for producing a gate signal comprises means for producing a DC gate signal in response to said polyphonic audio signal.

10. The improvement according to claim 9 wherein said means for developing a polyphonic audio signal includes a plurality of first switches each operable in response to depression of a respective key of said keyboard and wherein said means for developing a monophonic audio signal includes a plurality of second switches each operable together with a respective one of said first switches.

11. An electronic musical instrument having combined monophonic and polyphonic sound producing capabilities comprising:

a plurality of player operable keys each representing a different pitch of a musical scale;

polyphonic means for producing a first audio signal having frequency components representing the pitches of all of said keys which are depressed;

means for producing a gate signal in response to said first audio signal;

monophonic means enabled in response to said gate signal for producing a second audio signal having a frequency representing the pitch of only one of said keys which are depressed;

means for producing a third audio signal representing the sum of said first and second audio signals; and voltage controlled means responsive to said gate signal for controllably processing said third audio signal.

* * * * *